US012540753B2

(12) United States Patent
Ding et al.

(10) Patent No.: US 12,540,753 B2
(45) Date of Patent: Feb. 3, 2026

(54) DUCTED TYPE AIR CONDITIONER

(71) Applicant: Gree Electric Appliances, Inc. of Zhuhai, Guangdong (CN)

(72) Inventors: Shaojun Ding, Guangdong (CN); Xiaolong Chi, Guangdong (CN); Yifan Zhang, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 98 days.

(21) Appl. No.: 18/682,178

(22) PCT Filed: Oct. 9, 2022

(86) PCT No.: PCT/CN2022/124018
§ 371 (c)(1),
(2) Date: Feb. 8, 2024

(87) PCT Pub. No.: WO2023/087968
PCT Pub. Date: May 25, 2023

(65) Prior Publication Data

US 2025/0129966 A1 Apr. 24, 2025

(30) Foreign Application Priority Data

Nov. 20, 2021 (CN) ..... 202111381043.5

(51) Int. Cl.
*F24F 13/22* (2006.01)
*F24F 13/02* (2006.01)

(52) U.S. Cl.
CPC ..... *F24F 13/222* (2013.01); *F24F 13/02* (2013.01)

(58) Field of Classification Search
CPC ..... F24F 1/0022; F24F 1/0018; F24F 13/222; F24F 13/22; F24F 13/02; F24F 1/0014; F24F 1/0033; F24F 11/79; F24F 13/06
See application file for complete search history.

(56) References Cited

U.S. PATENT DOCUMENTS

2018/0238581 A1* 8/2018 Yokota ..... F24F 1/0029

FOREIGN PATENT DOCUMENTS

| | | | | | |
|---|---|---|---|---|---|
| CN | 105402811 | A | * | 3/2016 | ..... F24F 13/06 |
| CN | 105605682 | A | | 5/2016 | |
| CN | 109489216 | A | * | 3/2019 | |
| CN | 112880026 | A | | 6/2021 | |
| CN | 214307342 | U | | 9/2021 | |
| CN | 214581542 | A | | 11/2021 | |
| CN | 216769592 | U | | 6/2022 | |
| CN | 114763929 | A | | 7/2022 | |
| CN | 216897541 | U | | 7/2022 | |
| JP | H11141905 | A | | 5/1999 | |

* cited by examiner

*Primary Examiner* — Frantz F Jules
*Assistant Examiner* — Martha Tadesse
(74) *Attorney, Agent, or Firm* — The Webb Law Firm

(57) ABSTRACT

The ducted type air conditioner provided by the present disclosure, including a shell, an air opening being formed in the shell; a fan, rotatably arranged in the shell; and a water-receiving disk, arranged in the shell and located between the fan and the air opening; in the case that the air opening serves as an air inlet, the orientation of an air-absorbing opening of the fan inclines upwards relative to a horizontal direction; or in the case that the air opening serves as an air outlet, the orientation of an exhaust opening of the fan inclines upwards relative to a horizontal direction.

8 Claims, 2 Drawing Sheets

DUCTED TYPE AIR CONDITIONER

CROSS-REFERENCE TO RELATED APPLICATIONS

The application is the United States national phase of International Application No. PCT/CN2022/124018, filed Oct. 9, 2022, and claims priority to Chinese Patent Application No. 202111381043.5, filed Nov. 20, 2021, the disclosures of which are hereby incorporated by reference in their entireties.

BACKGROUND OF THE INVENTION

Field of the Invention

The present disclosure relates to the technical field of air conditioners, and in particular to a ducted type air conditioner.

Description of Related Art

A ducted type air conditioner is one of air conditioners. To improve the comfortability, some ducted type air conditioners adopt the mode of discharging cold air from the top and hot air from the bottom, thereby achieving waterfall refrigeration and carpet heating. To achieve this air outlet mode, it is necessary to change the flow direction of the air in the ducted type air conditioner. However, in the ducted type air conditioner in the related art, the airflow in the ducted type air conditioner is adjusted by adjusting the arrangement position of a fan and a heat exchanger. The influence of a water-receiving disk on the air input of the fan, even on the airflow in the ducted type air conditioner is not considered, resulting in the problem of low heat exchange efficiency of the ducted type air conditioner.

SUMMARY OF THE INVENTION

The present disclosure provides a ducted type air conditioner, which can solve the problem of low heat exchange efficiency of a ducted type air conditioner in the related art.

The present disclosure provides a ducted type air conditioner, including:

a shell, an air opening being formed in the shell;

a fan, rotatably arranged in the shell;

a water-receiving disk, arranged in the shell and located between the fan and the air opening;

in the case that the air opening serves as an air inlet, the orientation of an air-absorbing opening of the fan inclines upwards relative to a horizontal direction; or in the case that the air opening serves as an air outlet, the orientation of an exhaust opening of the fan inclines upwards relative to a horizontal direction.

In the ducted type air conditioner according to some embodiments, in the case that the air opening serves as an air inlet, the orientation of the air-absorbing opening and the horizontal direction form a first inclination angle $\alpha$, and the angle range of the first inclination angle $\alpha$ is $0° < \alpha \leq 12°$.

In the ducted type air conditioner according to some embodiments, in the case that the air opening serves as an air outlet, the orientation of the exhaust opening and the horizontal direction form a second inclination angle $\beta$, and the angle range of the second inclination angle $\beta$ is $0° < \beta \leq 15°$.

In the ducted type air conditioner according to some embodiments, the air opening includes a lower air opening, and the water-receiving disk is arranged between the lower air opening and the fan; or the fan includes a side air opening, and the water-receiving disk is arranged between the side air opening and the fan.

In the ducted type air conditioner according to some embodiments, the air opening includes a lower air opening; the fan has a first orientation and a second orientation; in the first orientation, the lower air opening serves as an air inlet; and in the second orientation, the lower air opening serves as an air outlet.

In the ducted type air conditioner according to some embodiments, in the switching process of the fan between the first orientation and the second orientation, the rotation angle of the fan is less than 180°, and the fan has a position where the orientation of the exhaust opening is vertically upward.

In the ducted type air conditioner according to some embodiments, in the switching process of the fan between the first orientation and the second orientation, the rotation angle of the fan is greater than 180°, and the fan has a position where the orientation of the exhaust opening is vertically downward.

In the ducted type air conditioner according to some embodiments, the shell further includes a side air opening; in the first orientation, the side air opening serves as an air outlet; and in the second orientation, the side air opening serves as an air inlet.

In the ducted type air conditioner according to some embodiments, in the case that the ducted type air conditioner is in a refrigeration mode, the fan is in the first orientation and the lower air opening serves as an air inlet; and in the case that the ducted type air conditioner is in a heating mode, the fan is in the second orientation and the lower air opening serves as an air outlet.

In the ducted type air conditioner according to some embodiments, the ducted type air conditioner further includes a heat exchanger; the heat exchanger is arranged in the shell; and the water-receiving disk is located below the heat exchanger.

In the ducted type air conditioner according to some embodiments, the fan is a mixed flow fan.

According to the ducted type air conditioner provided by the present disclosure, the air-absorbing opening or exhaust opening of the fan inclines upwards relative to the horizontal direction when facing the water-receiving disk, that is, the air opening of the fan inclines away from water-receiving disk when facing the water-receiving disk, so that the influence of the water-receiving disk on the air volume of the fan is effectively reduced, the flowability of the airflow in the shell is ensured, and the heat exchange efficiency of the ducted type air conditioner is improved.

Figure 1:
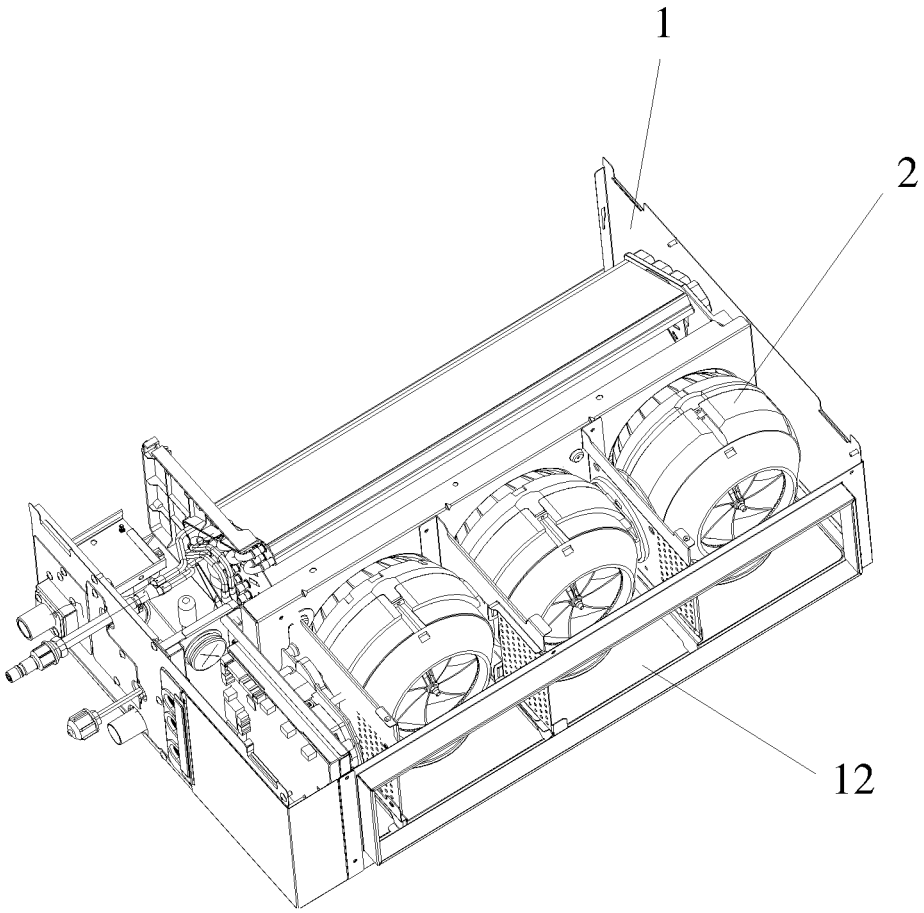
FIG. 1 is a structural schematic diagram of a ducted type air conditioner according to an embodiment of the present disclosure.

In the drawings: 1. shell; 11. lower air opening; 2. fan; 3. water-receiving disk; 21. air-absorbing opening; 22. exhaust opening; 12. side air opening; 4. heat exchanger.

DESCRIPTION OF THE INVENTION

The present disclosure is further described below in conjunction with the embodiments, but is not limited to the content in the specification.

In a related art, a heat exchanger is required to be arranged in an air duct in the ducted type air conditioner to exchange heat with gas, and the heat exchange will generate condensed water; therefore, a water-receiving disk is arranged below the heat exchanger and in the air duct to receive the condensed water generated on the heat exchange, thereby avoiding the influence on the use effect of the ducted type air conditioner by the dripping of the condensed water. An existing ducted type air conditioner only considers the receiving effect of the water-receiving disk on the condensed water, and the improvement of the heat exchange effect of the ducted type air conditioner aims at the fan or the heat exchanger. However, after the research of the applicant and the analysis of simulation experiment data, it is found that in the heat exchange process of the air ducted type air conditioner, all components in the air duct will affect the airflow in the air duct. By simplifying considering that the fan or the heat exchanger only can partially improve the heat exchange effect, and in order to ensure the receiving effect of the water-receiving disk, the water-receiving disk necessarily has a certain height, and the height plays a blocking role at the lower part of the air duct. Meanwhile, to reduce the occupied space of the ducted type air conditioner, the distance between the fan and the heat exchanger is reduced as much as possible, so that the water-receiving disk is close to the fan, and the water-receiving disk greatly affects the air input and output of the fan, that is, the water-receiving disk actually is an important factor affecting the airflow in the air duct. How to avoid the influence of the water-receiving disk on the air volume of the fan is an important parameter that can effectively improve the heat exchange efficiency of the ducted type air conditioner.

Figure 2:
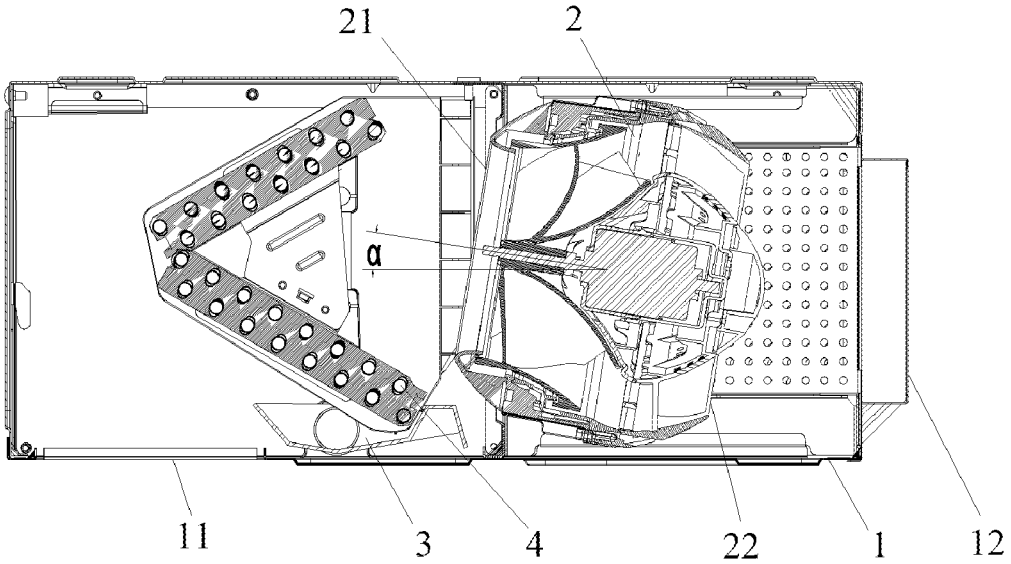
FIG. 2 is a sectional view of an air opening being a lower air opening and a ducted type air conditioner being in a refrigeration mode according to an embodiment of the present disclosure.
Figure 3:
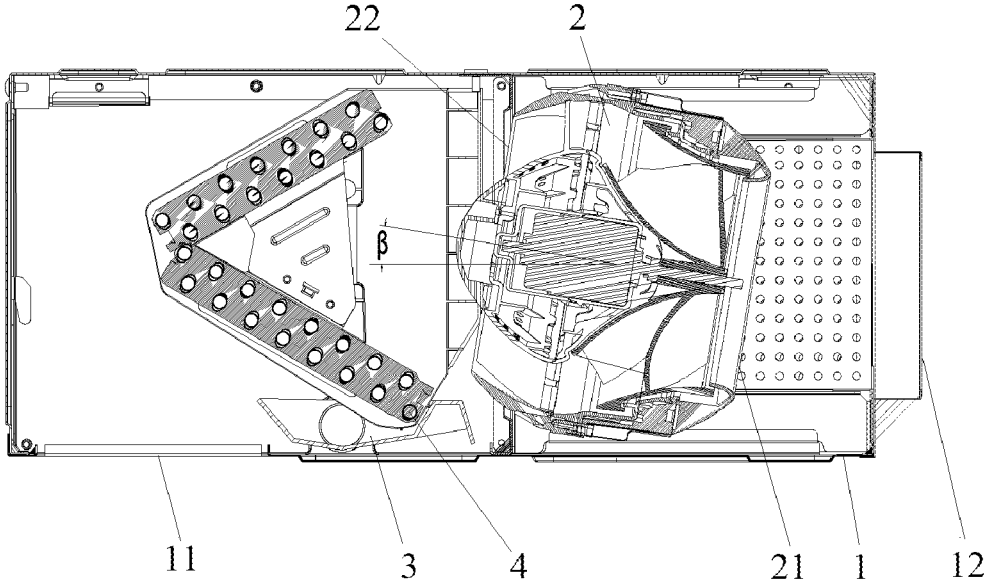
FIG. 3 is a sectional view of an air opening being a lower air opening and a ducted type air conditioner being in a heating mode according to an embodiment of the present disclosure.
Figure 4:
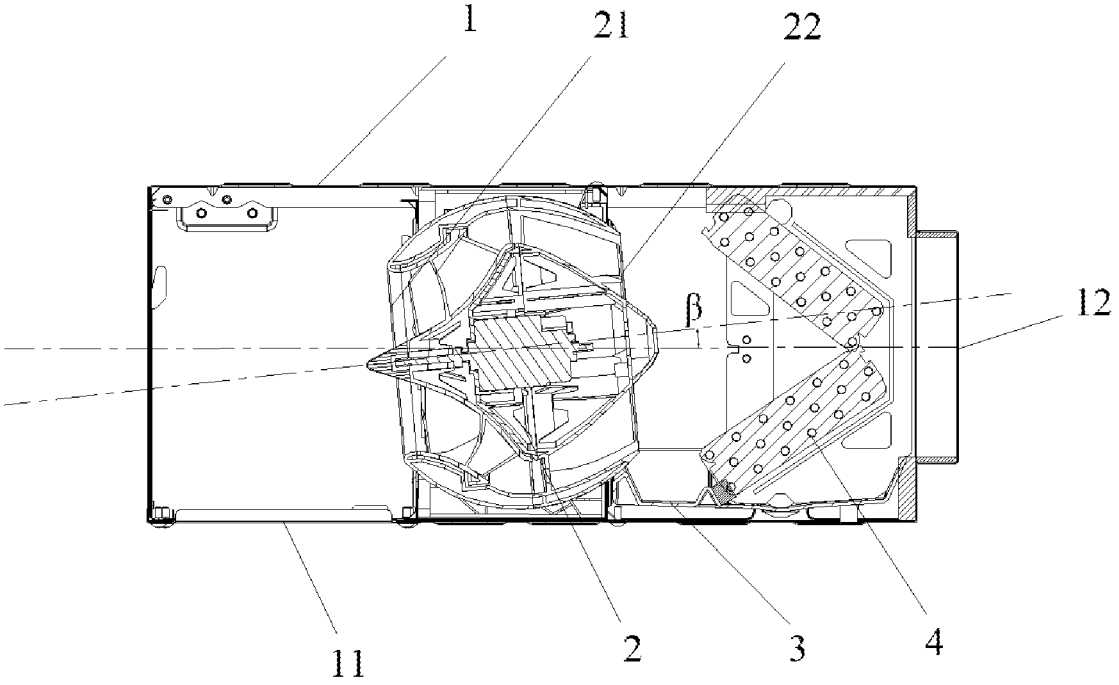
FIG. 4 is a sectional view of an air opening being a side air opening and a ducted type air conditioner being in a refrigeration mode according to an embodiment of the present disclosure.

Therefore, as shown in FIG. 1 to FIG. 4, the present disclosure provides a ducted type air conditioner, including: a shell 1, where an air opening is formed in the shell 1; a fan 2, where the fan 2 is rotatably arranged in the shell 1; and a water-receiving disk 3, where the water-receiving disk 3 is arranged in the shell 1, and the water-receiving disk 3 is located between the fan 2 and the air opening. In the case that the air opening 11 serves as an air inlet, the orientation of an air-absorbing opening 21 of the fan 2 inclines upwards relative to a horizontal direction. In the case that the air opening 11 serves as an air inlet, the fan 2 absorbs gas from the air opening 11, the fan 2 inclines away from the water-receiving disk 3, and the air-absorbing opening 21 absorbs air from a part away from the water-receiving disk 3, so that the influence on the air input of the fan 2 due to the airflow blockage by the water-receiving disk 3 is avoided, the air volume of the fan 2 is ensured, and the heat exchange efficiency of the ducted type air conditioner is finally ensured.

Or, in the case that the air opening 11 serves as an air outlet, the orientation of an exhaust opening 22 of the fan 2 inclines upwards relative to a horizontal direction. In the case that the air opening 11 serves as an air outlet, the airflow discharged by the fan 2 is blown out through the air opening 11. Most of the airflow blown by the exhaust opening 22 of the fan 2 flows through a part above the water-receiving disk 3 and is not blocked by the water-receiving disk 3, so the air volume of the fan 2 is ensured, and the heat exchange effect of the ducted type air conditioner is finally ensured.

In the case that the air opening 11 serves as an air inlet, the orientation of the air-absorbing opening 21 and the horizontal direction form a first inclination angle $\alpha$, and the angle range of the first inclination angle $\alpha$ is $0° \leq \alpha \leq 12°$. Preferably, the angle range of the first inclination angle $\alpha$ is $0° < \alpha \leq 12°$.

The ducted type air conditioner of this example is subjected to a simulated test, and the value of the first inclination angle $\alpha$ is changed, where upward inclination relative to the horizontal direction is a positive angle, and downward inclination relative to the horizontal direction is a negative angle. The simulation result is as follows.

| Angle | Rotating Speed (rpm) | Air Volume ($m^3/h$) | Noise (dB) |
|---|---|---|---|
| −3.0 | 2200 | 478 | 46.2 |
| 0.0 | 2200 | 518 | 43.5 |
| 7.5 | 2200 | 533 | 42.2 |
| 12.0 | 2200 | 525 | 43.7 |
| 14.0 | 2200 | 493 | 45.8 |

According to the simulation data, in a case that $\alpha$ is 7.5°, the air volume reaches a maximum value, and the noise reaches a minimum value; in a case that $\alpha$ increases to 12°, the air volume begins to decrease and the noise begins to increase; in a case that $\alpha$ continuously increases to 14°, the attenuation of the air volume continuously increases and the noise increases obviously; in a case that $\alpha$ decreases to 0°, the air volume begins to decrease and the noise begins to increase; and in a case that $\alpha$ continuously decreases to −3°, the attenuation of the air volume continuously increases and the noise increases obviously. That is, in a case that the first inclination angle $\alpha$ is in the range of $0° \leq \alpha \leq 12°$, the deviations of the air volume and the noise are small and the effect is the best, and the change is great after a critical value is exceeded, so that the normal work of the ducted type air conditioner cannot be ensured.

In the case that the air opening 11 serves as an air outlet, the orientation of the exhaust opening 22 and the horizontal direction form a second inclination angle $\beta$, and the angle range of the second inclination angle $\beta$ is $0° \leq \beta \leq 15°$. Preferably, the angle range of the second inclination $\beta$ is $0° < \beta \leq 15°$.

The mixed flow fan of this example is subjected to a simulated test, and the value of the second inclination angle $\beta$ is changed, where upward inclination relative to the horizontal direction is a positive angle, and downward inclination relative to the horizontal direction is a negative angle. The simulation result is as follows:

| Angle | Rotating Speed (rpm) | Air Volume ($m^3/h$) | Noise (dB) |
|---|---|---|---|
| −2.0 | 2200 | 469 | 48.8 |
| 0.0 | 2200 | 504 | 42.8 |
| 7.2 | 2200 | 526 | 41.3 |
| 15.0 | 2200 | 510 | 42.6 |
| 16.0 | 2200 | 476 | 44.2 |

According to the simulation data, in a case that $\beta$ is 7.2°, the air volume reaches a maximum value, and the noise reaches a minimum value; in a case that β increases to 15°, the air volume begins to decrease and the noise begins to increase; in a case that β continuously increases to 16°, the attenuation of the air volume continuously increases and the noise increases obviously; in a case that β decreases to 0°, the air volume begins to decrease and the noise begins to increase; and in a case that β continuously decreases to −2°, the attenuation of the air volume continuously increases and the noise increases obviously. That is, in a case that the second inclination angle β is in the range of $0° \leq \beta \leq 15°$, the deviations of the air volume and the noise are small and the effect is the best, and the change is great after a critical value is exceeded, so that the normal work of the ducted type air conditioner cannot be ensured.

The air opening includes a lower air opening 11, and the water-receiving disk 3 is arranged between the lower air opening 11 and the fan 2; or the air opening includes a side air opening 12, and the water-receiving disk 3 is arranged between the side air opening 12 and the fan 2.

The air opening includes a lower air opening 11; the fan 2 has a first orientation and a second orientation; in the first orientation, the lower air opening 11 serves as an air inlet; and in the second orientation, the lower air opening 11 serves as an air outlet. That is, the ducted type air conditioner can switch the air inlet and outlet directions according to the orientation switching of the fan 2.

In the switching process of the fan 2 between the first orientation and the second orientation, the rotation angle of the fan 2 is less than 180°, and the fan 2 has a position where the orientation of the exhaust opening is vertically upward. That is, in the rotating process of the fan 2, the orientation of the exhaust opening 22 of the fan is upward rotation first and then downward rotation.

In the switching process of the fan 2 between the first orientation and the second orientation, the rotation angle of the fan 2 is greater than 180°, and the fan 2 has a position where the orientation of the exhaust opening is vertically downward. That is, in the rotating process of the fan 2, the orientation of the exhaust opening 22 of the fan is downward rotation first and then upward rotation.

The shell further includes a side air opening 12; in the first orientation, the side air opening 12 serves as an air outlet; and in the second orientation, the side air opening 12 serves as an air inlet.

In the case that the ducted type air conditioner is in a refrigeration mode, the fan 2 is in the first orientation, the lower air opening 11 serves as an air inlet, and at this time, the side air opening 12 serves as an air outlet to realize horizontal air output to achieve the waterfall refrigeration effect; and in the case that the ducted type air conditioner is in a heating mode, the fan 2 is in the second orientation, the lower air opening 11 serves as an air outlet, and the side air opening 12 serves as an air inlet, so that vertically downward heating is realized, and the rapid heating effect is achieved.

The ducted type air conditioner further includes a heat exchanger 4; the heat exchanger 4 is arranged in the shell 1; and the water-receiving disk 3 is located below the heat exchanger 4.

The fan 2 is a mixed flow fan.

Apparently, the above implementation manners of the present disclosure are only examples for clearly describing the present disclosure and do not limit the implementation manners of the present disclosure. Those skilled in the art may make modifications in other forms based on the above description. All of the implementation manners cannot be exhausted here. All obvious changes or modifications that belong to the technical solutions of the present disclosure shall still fall within the protection scope of the present disclosure.

The invention claimed is:

1. A ducted type air conditioner, comprising:

a shell, an air opening being formed in the shell;

a fan, being rotatably arranged in the shell; and a water-receiving disk, being arranged in the shell and located between the fan and the air opening;

wherein the air opening comprises a lower air opening, and the water-receiving disk is arranged between the lower air opening and the fan;

in the case that the air opening serves as an air inlet, an orientation of an air-absorbing opening of the fan inclines upwards relative to a horizontal direction, and the orientation of the air-absorbing opening and the horizontal direction are configured to form a first inclination angle α, the angle range of which is $0° < \alpha < 12°$; and/or in the case that the air opening serves as an air outlet, an orientation of an exhaust opening of the fan inclines upwards relative to a horizontal direction, and the orientation of the exhaust opening and the horizontal direction are configured to form a second inclination angle β, the angle range of which is $0° < \beta < 15°$.

2. The ducted type air conditioner according to claim 1, wherein the air opening comprises a lower air opening; the fan has a first orientation and a second orientation; in the first orientation, the lower air opening serves as an air inlet; and in the second orientation, the lower air opening serves as an air outlet.

3. The ducted type air conditioner according to claim 2, wherein in the switching process of the fan between the first orientation and the second orientation, the rotation angle of the fan is less than 180°, and the fan has a position where the exhaust orientation of the exhaust opening is vertically upward.

4. The ducted type air conditioner according to claim 2, wherein in the switching process of the fan between the first orientation and the second orientation, the rotation angle of the fan is greater than 180°, and the fan has a position where the exhaust orientation of the exhaust opening is vertically downward.

5. The ducted type air conditioner according to claim 2, wherein the shell further comprises a side air opening; in the first orientation, the side air opening serves as an air outlet; and in the second orientation, the side air opening serves as an air inlet.

6. The ducted type air conditioner according to claim 2, wherein in the case that the ducted type air conditioner is in a refrigeration mode, the fan is in the first orientation and the lower air opening serves as an air inlet; and in the case that the ducted type air conditioner is in a heating mode, the fan is in the second orientation and the lower air opening serves as an air outlet.

7. The ducted type air conditioner according to claim 1, wherein the ducted type air conditioner further comprises a heat exchanger; the heat exchanger is arranged in the shell; and the water-receiving disk is located below the heat exchanger.

8. The ducted type air conditioner according to claim 1, wherein the fan is a mixed flow fan.

* * * * *